US006652791B1

(12) United States Patent
Peters

(10) Patent No.: US 6,652,791 B1
(45) Date of Patent: Nov. 25, 2003

(54) METHOD OF MANUFACTURING A REINFORCED OBLONG CONCRETE DRIVING PILE FOR LONGITUDINAL LOAD-BEARING PURPOSES

(76) Inventor: Peter Cornelis Peters, Naarderweg 22, NL-1261 BT Blaricum, BT Blaricum (NL)

( * ) Notice: Subject to any disclaimer, the term of this patent is extended or adjusted under 35 U.S.C. 154(b) by 0 days.

(21) Appl. No.: 09/566,102

(22) Filed: May 5, 2000

Related U.S. Application Data

(63) Continuation of application No. PCT/NL98/00643, filed on Nov. 6, 1998.

(30) Foreign Application Priority Data

Nov. 7, 1997 (NL) ..... 1007476

(51) Int. Cl.[7] ..... B28B 21/52; B28B 21/56; B28B 21/60; B28B 21/66

(52) U.S. Cl. ..... 264/159; 264/171.26; 264/171.14; 264/209.1; 264/211.11; 264/228; 264/229; 425/111

(58) Field of Search ..... 264/228, 229, 264/157, 159, 209.1, 211.11, 171.14, 171.26; 425/111

(56) References Cited

U.S. PATENT DOCUMENTS

| | | | | | |
|---|---|---|---|---|---|
| 2,607,099 | A | * | 8/1952 | Schroder et al. | |
| 3,146,508 | A | * | 9/1964 | Berliner et al. | |
| 3,150,428 | A | * | 9/1964 | Mast | |
| 3,181,222 | A | * | 5/1965 | Palmer | |
| 3,200,177 | A | | 8/1965 | Dodd | 264/70 |
| 3,283,385 | A | * | 11/1966 | Oakden | |
| 3,382,680 | A | * | 5/1968 | Takano | |
| 3,605,217 | A | * | 9/1971 | Martens et al. | |
| 3,989,431 | A | | 11/1976 | Martens | 425/112 |
| 4,132,082 | A | | 1/1979 | Merjan | 405/253 |
| 4,293,242 | A | | 10/1981 | Merjan | 405/239 |
| 4,297,414 | A | * | 10/1981 | Matsumoto | 264/177.17 |
| 4,832,746 | A | * | 5/1989 | Yachi et al. | 106/640 |
| 5,320,453 | A | * | 6/1994 | Bullivant | 405/239 |
| 5,451,471 | A | * | 9/1995 | Over et al. | 428/574 |
| 5,680,735 | A | * | 10/1997 | Bates | 52/220.2 |

FOREIGN PATENT DOCUMENTS

| | | | | |
|---|---|---|---|---|
| DE | 38 27 703 A1 | | 2/1990 | |
| EP | 0 565 816 A1 | | 10/1993 | |
| GB | 2 062 073 A | | 5/1981 | |
| JP | 2-285108 A | * | 11/1990 | B28B/21/56 |
| JP | 04086202 | | 3/1992 | |
| WO | WO-93/25778 A1 | * | 12/1993 | E04C/2/26 |
| WO | WO 00/71315 A1 | * | 11/2000 | B28B/1/52 |

* cited by examiner

*Primary Examiner*—Richard Crispino
*Assistant Examiner*—Michael I. Poe
(74) *Attorney, Agent, or Firm*—Akin Gump Strauss Haur & Feld, L.L.P.

(57) ABSTRACT

The invention relates to a method of manufacturing a reinforced oblong concrete product for longitudinal load-bearing purposes, in particular a driving pile. According to the present invention reinforcing fibers are used to prevent break-up of the concrete due to radial forces which occur during driving, and the concrete composition is provided with said reinforcing fibers before the concrete composition is applied to the reinforcing wire. This method reduces the amount of heavy labour and cost. The invention also relates to a driving pile comprising reinforcing fibers.

8 Claims, 1 Drawing Sheet

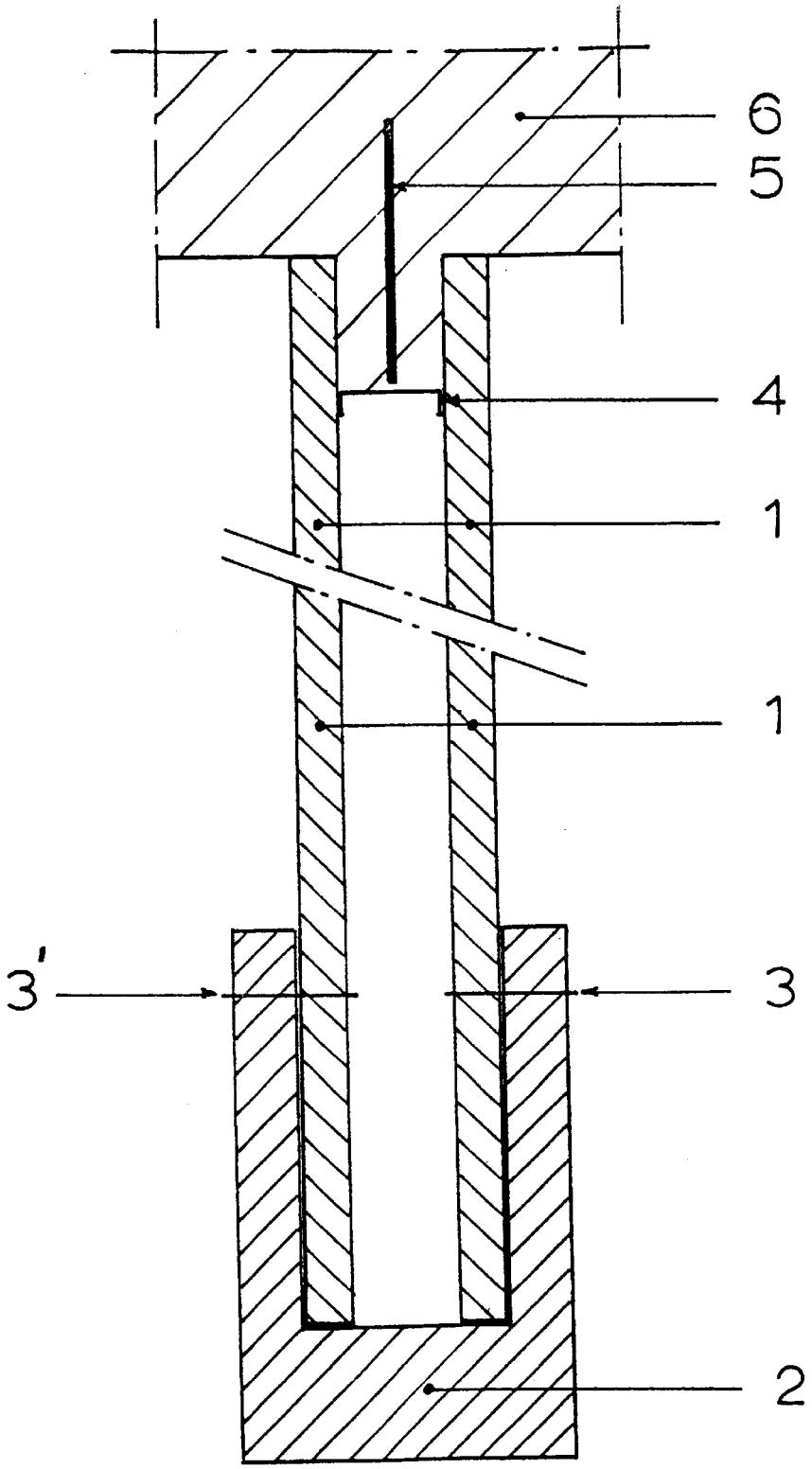
FIG.

METHOD OF MANUFACTURING A REINFORCED OBLONG CONCRETE DRIVING PILE FOR LONGITUDINAL LOAD-BEARING PURPOSES

CROSS REFERENCE TO RELATED APPLICATION

This Application is a continuation of International Application PCT/NL98/00643, filed Nov. 6, 1998.

BACKGROUND OF THE INVENTION

The present invention relates to a method of manufacturing a reinforced oblong concrete product for longitudinal load-bearing purposes, said method comprising the steps of i) putting at least one prestress reinforcing wire under tension, said wire having a length of at least the length of the finished product and oriented in a direction substantial parallel to the longitudinal axis of the finished product; ii) providing means to prevent break-up of the concrete product due to radial forces; iii) applying a concrete composition to the reinforcing wire, the concrete composition being applied using a forming machine such that over substantially the entire length of the finished concrete product a channel is formed; and iv) allowing said concrete composition to harden.

Such a method is known from U.S. Pat. No. 3,200,177. To prevent break-up due to radial forces, the means provided are, for example, stirrups.

This method suffers from several draw backs, firstly, this method is very labour-intensive, as stirrups have to be provided, often over the full length of the concrete product. This usually has to be done in an uncomfortable position for the worker. The resulting concrete product is relatively expensive.

Such a method is generally known in the art for the manufacture of driving piles or columns. In particular, it is known to provide a trough, having a length of, for example, 100 m, with, usually, at least one pair of partition walls. Each partition wall is provided with holes for prestress reinforcing wire. At least near the partition wall and at the ends of the trough, stirrups are provided. It is not uncommon to provide stirrups over the full length of the trough (except between partition walls of a pair of partition walls). Stirrups are means to prevent break-up of the concrete due to radial forces, such as those occurring during driving. Subsequently at least one reinforcing wire is passed through holes of the partition walls. Each of the reinforcing wires is prestressed and the trough is filled with a concrete composition, which is subsequently allowed to harden.

This method suffers from several drawbacks. Firstly, this method is very labour-intensive, as the reinforcing wire has to be passed over the length of the trough through the stirrups, which are usually spiral-shaped elements. In addition, as the troughs lay on the floor, this has to be done in an uncomfortable position for the worker. The resulting concrete product is relatively expensive. Secondly, each driving pile with a different cross-sectional size or shape requires a different trough. Troughs not in use occupy floor space and are not productive, and for these reasons increase cost.

SUMMARY OF THE INVENTION

The object of the present invention is to provide a method of manufacturing a reinforced oblong concrete product which is less labour-intensive and strenuous, and yields a cheaper product.

Accordingly, the method according to the present invention is characterized in that reinforcing fibres are used as the means to prevent break-up of the concrete due to radial forces, and the concrete composition is provided with said reinforcing fibres before the concrete composition is applied to the reinforcing wire.

By including reinforcing fibres, the use of stirrups can be reduced or even completely abstained from, allowing faster manufacturing of concrete products. As the fibres are present throughout the concrete product, in particular near the surface of the concrete product also, a product of higher strength is obtained. This may also allow for the manufacture of concrete products with a reduced cross-section maintaining equal strength properties, further reducing cost, including cost of handling, transportation and concrete composition base materials. Suitable fibres are, for example, carbon fibre, natural fibres such as flax and ramie, and superfibres such as aramide fibres (Twaron™) or polyamide (Dyneema™) Thus, using a semi-solid concrete composition, it is possible to forgo the trough and producing directly on the floor, further reducing manufacturing cost. More over, it is feasible to produce concrete products having various shapes, in particular, but not limited to, hollow or I-beam-shaped products. This allows for a substantial saving in base material. In the present application the use of a forming-machine should be understood as the use of a slide-former or an extruder, or combination thereof. Such a slide-former or extruder may be provided with vibrating means to ensure a higher product quality. Both slide-formers and extruders are known in the art for the manufactory of concrete products.

The use of reinforcing fibres is generally known in the art of manufacturing concrete products for a long time, but never has it occurred to the expert that it would be possible to improve the manufacture of a reinforced oblong concrete product for longitudinal load-bearing purposes as outlined above.

According to a preferred embodiment, reinforcing fibres are used provided with means for mechanically anchoring in the concrete.

By using fibres having a shape allowing for mechanically anchoring in the concrete, the amount of fibres required to provide for sufficient resistance against radial forces can be reduced. Advantageous fibres are, for example, fibres having a wider diameter at or near the opposite ends of the fibres, or fibres comprising at least one bend, such as S-shaped fibres.

Preferably steel fibres are used as the reinforcing fibres.

Steel fibres are cheap and have excellent tensile strength properties. Suitable steel fibres are Dramix™ and Silidus™. It goes without saying that with higher the tensile strength, less fibre material is needed to obtain a product meeting the required product specifications.

The person skilled in the art can easily determine the amount of fibres required through routine experimentation. This amount is determined by the load, in particular the dynamic load, on the concrete product, during installation (driving). The amount of fibres must be increased until no substantial damage is observed when testing with a force that is at least as strong as those expected in any of the above stages. It goes without saying that the concrete composition may comprise any conventional addition, such as a plastifier to adjust the viscosity of the concrete composition.

According to a preferred embodiment, at least one reinforcing wire having a length which is at least equal to the length of at least two finished concrete products is used, and the hardened concrete comprising the reinforcing wire is cut to yield the finished concrete products of the desired length.

With the method according to the present invention, it is possible to reduce or forgo the use of partition walls. Currently, the reinforcing wire(s) between a pair of partition walls is cut. Then the hardened concrete pile is lifted from the trough and the partition walls are removed, after which the projecting ends of the reinforcing wire are ground off. All this is very labour-intensive, increasing cost and reducing the degree of capacity utilization of the plant. With the method according to the present invention, the concrete products can be cut at the required length, for example using a diamond saw. Optionally, this single step may be automated.

As desired or necessary, the concrete composition may be applied in one or more steps.

Finally, the present invention relates to a driven pile assembly comprising i) a reinforced oblong concrete product; and ii) a foot member having a base area larger than the cross-sectional area of the oblong concrete product, at least one of the product and the foot member comprising a channel and reinforcing fibres, and one of the oblong concrete product and the foot member is capable of engaging the other.

Such a driven pile assembly may sport a pile which, due to the presence of the reinforcing fibres, has a wellprotected surface, and may well be cheaper as its cross-section may be reduced with respect to conventional driving piles. The foot member ensures a large base area.

Applying the method according to the present invention is perfectly within the scope of a person skilled in the art. Both slide forming and extrusion of concrete products is very well known and the concrete compositions to be used with the present method are essentially the same as are currently in use.

DETAILED DESCRIPTION OF THE INVENTION

With reference to the only FIGURE, the present invention is now illustrated by way of example. The FIGURE shows a hollow driving pile 1 manufactured using slide forming, comprising reinforcing wire and reinforcing fibres (not shown). The driving pile 1 is provided with a foot 2, which allows for improved support through its larger base area. As shown, the foot 2 may be a sleeve-like section, which may or may not be fixed using connecting means 3, 3' such as pins or bolts. To assure a firm connection between the driving pile 1 and a foundation of the structure, such as a building, the following method is advantageously used. Barrier means 4 may be provided in the lumen of the driving pile 1 and a reinforcement rod 5 is inserted into the cavity. The barrier means 4 may be any means capable of preventing substantial loss of concrete into the lumen of the driving pile 1. Suitable barrier means 4 may for example be a thick paper plug, a plug of rockwool, a styrofoam plug, the lid of a paint can etc. The barrier means 4 may rest on a shoulder at the inside of the driving pile 1, or secured using a metal strip which is bended such that the ends of the strip rest on the rim of the end of the driving pile 1. Usually the reinforcing rod 5 will be attached to a reinforcing structure (not shown) to be cast into concrete. Subsequently, concrete is cast into the cavity and onto the reinforcing structure, and left to harden to form the foundation 6. After hardening a firm connection between driving pile 1 and the foundation 6 is assured. The above preferred embodiment allows for a considerable savings. Firstly, the fibre-reinforced driving pile 1 is considerably easier to manufacture, the savings in material further lowering the cost. Secondly, it is easy to achieve a firm connection between the driving pile 1 and the foundation 6, which does not require labour-intensive and time-consuming removing concrete from the top of the pile to expose the ends of the reinforcing wires. Finally, the optional use of a foot 2 may allow a further reduction in material.

I claim:

1. A method of manufacturing a reinforced oblong concrete driving pile for longitudinal load-bearing purposes, the method comprising the steps of:

i) putting at least one prestressed reinforcing wire under tension, the wire having a length of at least a length of the driving pile and being oriented in a direction substantially parallel to a longitudinal axis of the driving pile;

ii) providing reinforcing fibers to prevent break-up of the concrete driving pile due to radial forces;

iii) applying a concrete composition to the reinforcing wire using a forming machine, such that a channel is formed over substantially the entire length of the driving pile; and iv) allowing the concrete composition to harden;

wherein the reinforcing fibers are provided in an amount sufficient to prevent break-up of the concrete due to radial forces which occur during driving of the driving pile; and wherein the concrete composition is provided with the reinforcing fibers before the concrete composition is applied to the reinforcing wire.

2. The method according to claim 1, wherein the length of the reinforcing wire is at least equal to twice the length of the driving pile, the method further comprising the steps of:

(v) cutting the hardened concrete comprising the reinforcing wire to yield driving piles of a desired length.

3. The method according to claim 1, further comprising the steps of:

(v) forming a foot member having a base area larger than a cross-sectional area of the oblong concrete driving pile; and (vi) engaging the oblong concrete driving pile and the foot member to form a driving pile assembly.

4. The method according to claim 1, wherein the forming machine is selected from the group consisting of a slide former and an extruder.

5. The method according to claim 1, wherein the channel is surrounded by the concrete composition in the longitudinal direction.

6. The method according to claim 1, wherein the reinforcing fibers have a shape allowing for mechanical anchoring in the concrete.

7. The method according to claim 1, wherein the reinforcing fibers are selected from the group consisting of carbon fibers, natural fibers, superfibers, and steel fibers.

8. The method according to claim 7, wherein the reinforcing fibers comprise steel fibers.

* * * * *